US005531242A

United States Patent [19]

Paganessi

[11] Patent Number: 5,531,242

[45] Date of Patent: Jul. 2, 1996

[54] CYLINDER SOLVENT PUMPING SYSTEM

[75] Inventor: Joseph E. Paganessi, Burr Ridge, Ill.

[73] Assignee: American Air Liquide, Walnut Creek, Calif.

[21] Appl. No.: 176,756

[22] Filed: Dec. 28, 1993

[51] Int. Cl.[6] ..... F17D 1/00; F17C 13/00

[52] U.S. Cl. ..... 137/255; 137/334; 62/50.7

[58] Field of Search ..... 137/255, 334; 62/50.6, 50.7, 50.1

[56] References Cited

U.S. PATENT DOCUMENTS

| | | | |
|---|---|---|---|
| 4,898,673 | 2/1990 | Rice et al. | 210/634 |
| 5,058,616 | 10/1991 | Ohmi | 137/334 X |
| 5,214,925 | 6/1993 | Hoy et al. | 62/50.1 X |
| 5,237,824 | 8/1993 | Pawliszyn | 62/50.1 X |

*Primary Examiner*—Kevin Lee
*Attorney, Agent, or Firm*—Robert D. Touslee

[57] ABSTRACT

Disclosed is a system and method for using a system for delivery of fluid from cylinders comprising a plurality of supply cylinders containing fluid at or near supercritical conditions, each cylinder comprising a fluid outlet; sensing means for sensing at least one fluid property for each of said plurality of supply cylinders; heating means adapted to each of said plurality of supply cylinders and coupled to said sensing means to adjust the pressure of said fluid in said supply cylinders in response to said at least one fluid property to maintain said fluid at or near supercritical conditions; pump means to deliver fluid from said cylinder outlet to an application.

12 Claims, 3 Drawing Sheets

CYLINDER SOLVENT PUMPING SYSTEM

FIELD OF THE INVENTION

The present invention relates to a process and system for delivering a compressed liquified gas from at least one cylinder to an application using such a fluid.

BACKGROUND OF THE INVENTION

The use of supercritical fluids, such as supercritical carbon dioxide fluid, has been demonstrated to provide good results in the effort to replace undesirable volatile organic solvents presently used in many applications. For example, U.S. Pat. No. 4,923,720 describes a process and apparatus for coating substrates using a supercritical fluid as a coating diluent. However, the means to deliver a reliable and consistent supply of compressed liquified gas from conventional high pressure liquified gas cylinders to an application has been lacking to date. Prior to the system and method of the present invention, fluid recovery from cylinders is substantially and solely a function of the ambient temperature, with fluid recoveries decreasing with colder ambient conditions.

One method attempting to deliver liquified carbon dioxide from a cylinder to an application uses a siphon or "dip" tube to reach the bottom of an upright cylinder. Another method of attempting to consistently deliver liquified carbon dioxide from a cylinder comprises inverting the cylinder to place liquid in the cylinder at the cylinder outlet.

Unfortunately, both the siphon tube and the inversion method of withdrawing compressed liquified gas fail in practice when any of at least two conditions occurs. If the pressure drop in the flow line from the cylinder to the pump is greater than a few millibar, the liquid nature of the flowing fluid will cease, and a local vaporization will occur.

Also detrimental to deliver of compressed liquified gas is the formation of vapor due to temperature changes. If the temperature in the cylinder from which liquified gas fluid is being withdrawn falls below the ambient temperature, and therefore likely below the temperature of downstream delivery system components, vaporization of flowing fluid will probably occur. Unfortunately, any vaporization in the deliver system may cause delivery pumps to cavitate, thus causing the cessation of flow of fluid to the application.

Referring now to FIG. 1, the recovery of carbon dioxide from a conventional cylinder as a function of ambient (cylinder) temperature is depicted. It is seen that even at very high ambient conditions, less than about 70% of fluid is recovered.

From the above, it is clear that a reliable system and method for consistently supplying compressed liquified gas to an application using such fluid is much desired.

SUMMARY OF THE INVENTION

The present invention is directed to the use of a system of components which cooperate to deliver a consistent supply of compressed liquified gas to an application which uses such fluid. In one aspect, the system for delivery of compressed liquified gas from cylinders comprises, in combination, a plurality of supply cylinders containing fluid at or near supercritical conditions, each cylinder comprising a fluid outlet; sensing means for sensing at least one fluid property for each of said plurality of supply cylinders; heating means adapted to each of said plurality of supply cylinders and coupled to said sensing means to adjust the pressure of said fluid in said supply cylinders in response to said at least one sensed fluid property to maintain said fluid under predetermined, preferably supercritical conditions; and pump means to deliver fluid from said cylinder outlet to an application.

The present invention eliminates the problem of pump cavitation by sensing and maintaining the temperature and pressure of the $CO_2$ withdrawn from the cylinder above ambient temperature and preferably slightly greater than its supercritical temperature of about 31 degrees celsius. Under this condition, only a single fluid phase is present, and thus cavitation of the delivery pump is avoided.

At times, unwanted free water contamination may be present in the supply cylinders. Such water, if allowed to be pumped from the cylinder with fluid may lead to system contamination, and is thus desired to be avoided. Although the system of the present invention may be used with either siphoned or non-siphoned cylinders, it is preferable to practice the method using non-siphoned cylinders. As opposed to prior methods utilizing solely dip tubes and cylinder inversion, in accordance with the system and process of the present invention, if the cylinder containing compressed liquified gas is also contaminated with free water, by eliminating the siphon tubes or cylinder inversion techniques, the water phase is not aspirated by the pump.

The present invention also allows for the greater utilization/recovery of supercritical fluid from the cylinder. Typically, greater than about 80%, most likely about 90%, of the original fluid in the cylinder is recovered and pumped to the application.

In the preferred process of the present invention, two or more $CO_2$-containing cylinder banks, each bank comprising at least one $CO_2$-containing cylinder are connected with a manifold. Preferably, each cylinder bank is provided with a pressure sensing switch which is preferably preset to about 1100 psig, a temperature sensing switch preferably nominally preset to about 50° C., a heating element, and at least one $CO_2$-containing cylinder. The two or more cylinder banks are manifolded through the cylinder bank switching valve thus allowing the pump to draw fluid from the desired cylinder bank. By the use of cylinder banks, pressure maintenance more likely assumed and more efficient use of cylinder fluid contents occurs.

In another embodiment, a heat exchanger may be provided in the flowline between the switching valve and the pump to increase the recovery/utilization of $CO_2$. In the preferred system arrangement, the pump discharges the compressed supercritical fluid into a high pressure surge vessel. When demanded by an application, the high pressure fluid is then discharged from the high pressure surge vessel through a pressure regulator provided to constantly maintain a predetermined delivery pressure which is preferably between about 1200 and about 3000 psig for most applications.

In accordance with alternative embodiments of the present invention, a pressure switch is provided to determine the point at which the pumping rate into the high pressure surge vessel is significantly less than the withdrawal rate of fluid from the high pressure surge vessel. The inability of the pump to maintain the high pressure surge vessel's predetermined pressure above a preset value signals the switching valve to cease flow from the current supply cylinder bank and initiate delivery from an alternative cylinder bank.

DETAILED DESCRIPTION OF THE PREFERRED EMBODIMENTS

By using the process and apparatus of the present invention, a consistent and reliable supply of compressed liquified gas or supercritical fluid may be delivered to an application using such fluid. Supercritical fluids are known to have densities and other properties approaching those of a liquid. Moreover, it has been found that compounds of a high molecular weight, such as, for example, coating compositions, may be dissolved in a compressed liquified gas for use in many applications, such as, for example, spray coatings.

A multitude of compounds are known to have use as supercritical fluids, including carbon dioxide, ammonia, water, nitrous oxide, xenon, krypton, methane, ethane, ethylene, propane, pentane, methanol, ethanol, isopropanol, and isobutanol. Among these, supercritical carbon dioxide fluid and supercritical nitrous oxide fluid are preferred due to their low toxicity, nonflammability, and much lower cost versus other fluids. However, certain applications may require a specific compound exhibiting supercritical properties or a mixture of several compounds, and the present invention is not limited to the use of any particular such supercritical compound.

The process and system of the present invention is particularly suited to deliver fluid to applications demanding less than about 6 lbs/minute, preferably less than about 2 lbs/minute; however, the invention is not so limited.

Figure 1:
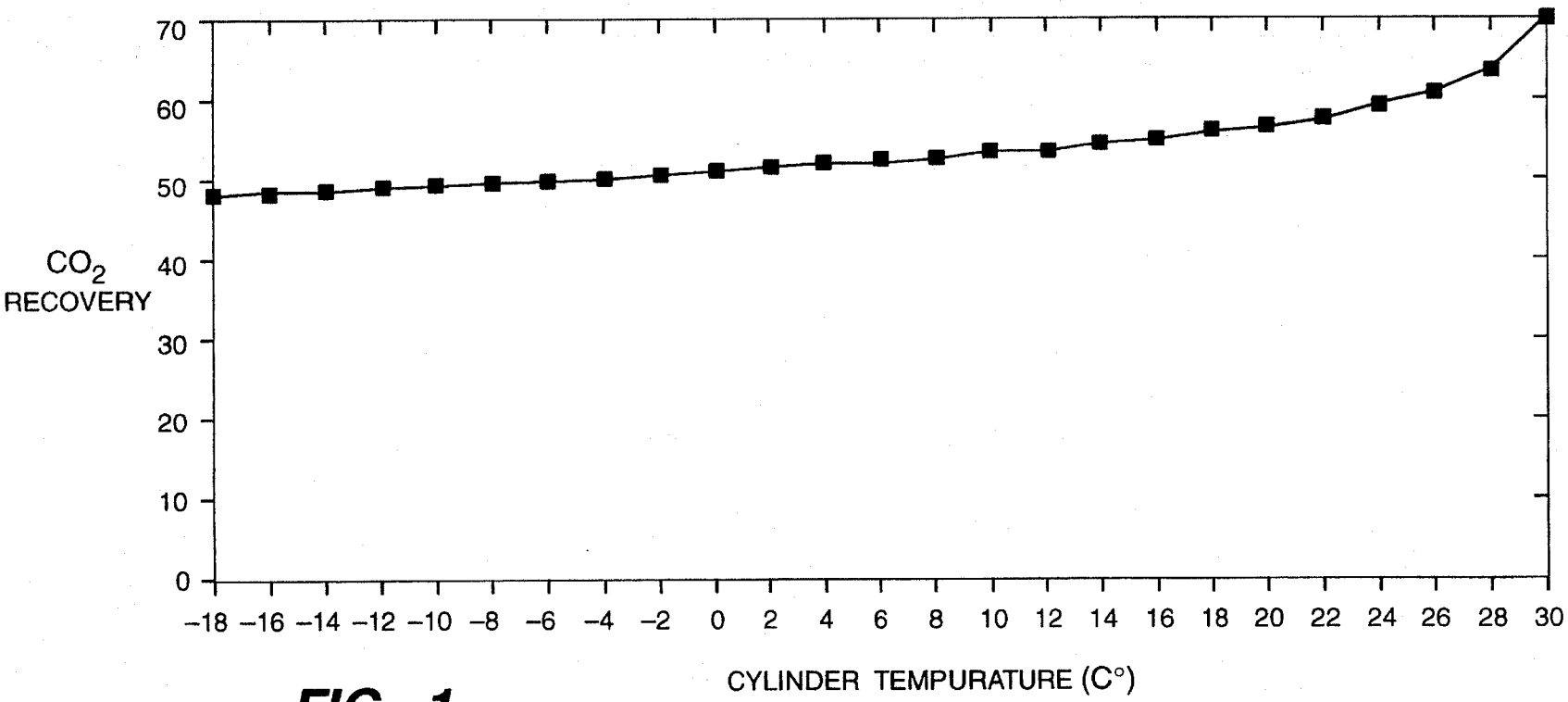
FIG. 1 graphically depicts fluid recovery from conventional cylinders as a function of temperature.
Figure 2:
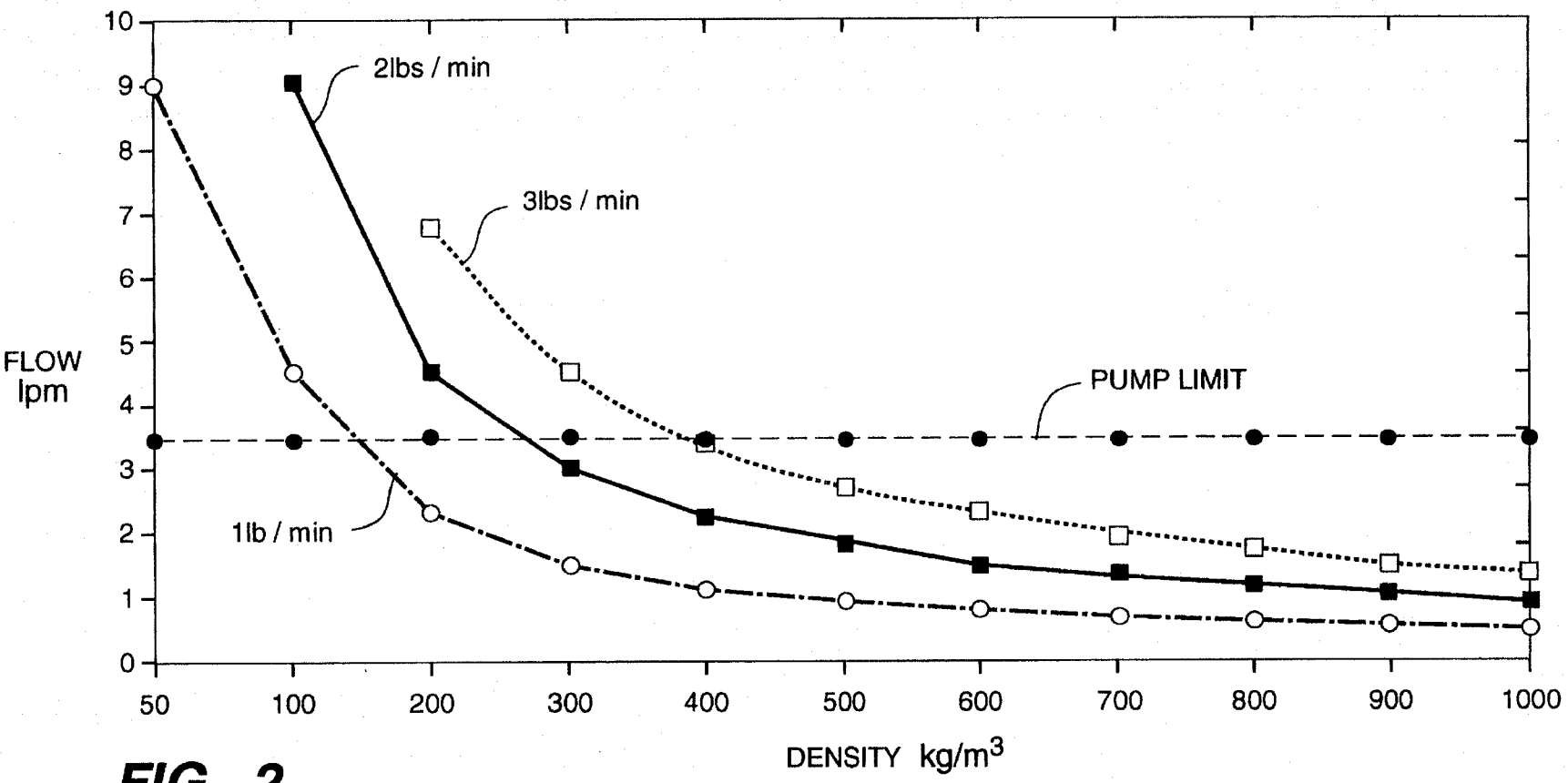
FIG. 2 is a graphical depiction of fluid flow as a function of density.

Referring now to FIG. 2, it is shown that the volumetric pumping capacity of the pump is fixed by the volumetric displacement of the pump multiplied by the frequency that the pump can operate. For FIG. 2, the particular pump in use has a capacity of about 3.5 liters per minute. If the withdrawal rate of $CO_2$ from the cylinder is 2 lbs/min, one can see from the curve that if the fluid density is less than about 260 kg/m$^3$, the pump will no longer be capable of supplying the desired mass flow rate of $CO^2$. As example, if the cylinder of $CO^2$ is at an ambient temperature of 20° C., the density of the liquid phase is 776.2 kg/m$^3$ while the density of the gas phase is 193.2 kg/m$^3$. The density of the gas phase is significantly lower than the limiting density of about 260 kg/m$^3$ at the desired mass flow rate; thus the pump is unable to meet the flow demand. If the cylinder is heated, the pressure increases; thus increasing the relative fluid density when compared to the density of the gas at the lower temperature. When the cylinder is heated to maintain a constant pressure at the same time that fluid is removed, the density of the remaining fluid slowly decreases until the limiting density of 260 kg/m$^3$ is reached, at which time the pumps is slowly unable to maintain the desired mass flow. When the cylinder cools to ambient temperature, the actual density in the cylinder will be about 167 kg/m$^3$.

Figure 3:
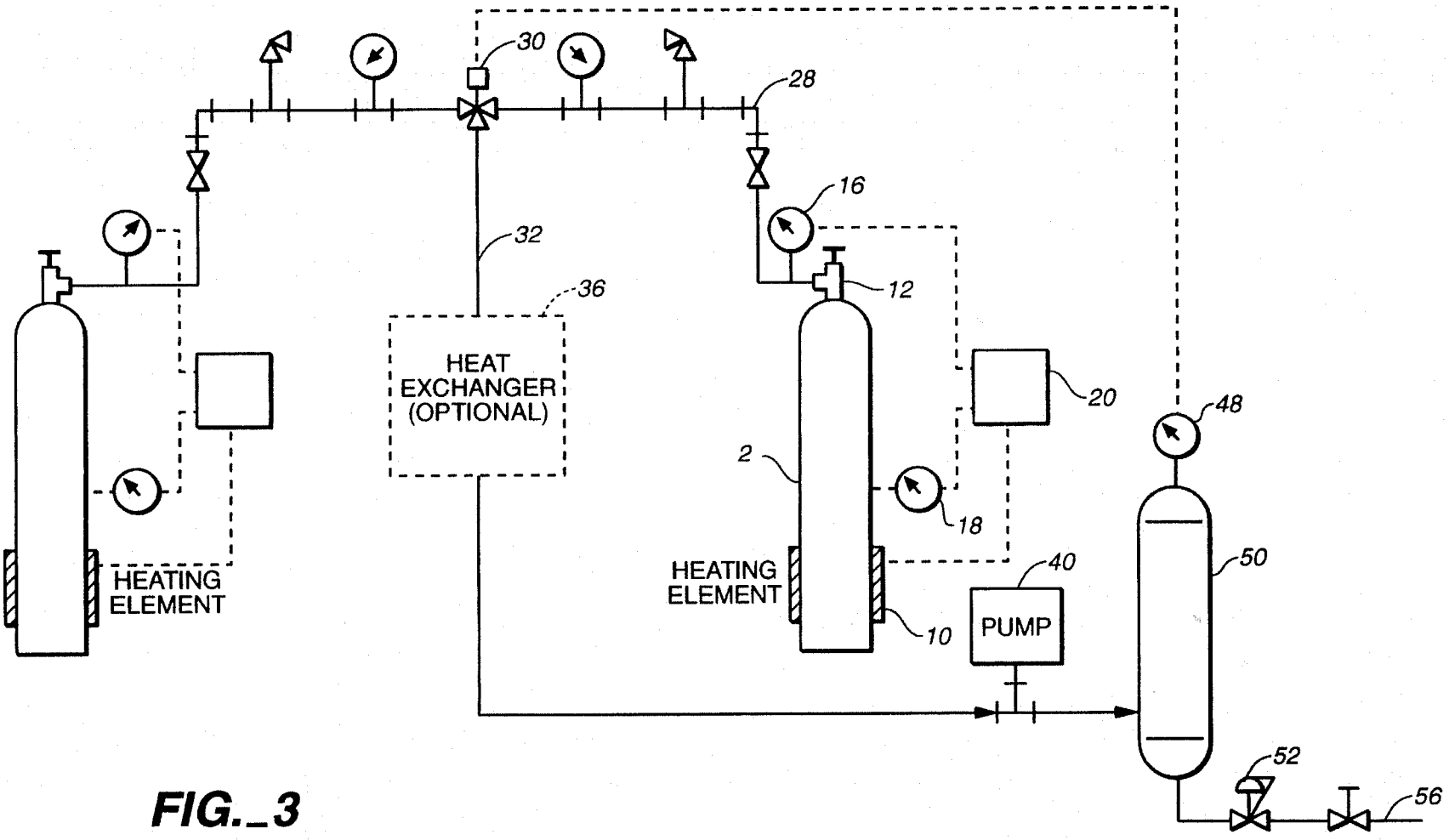
FIG. 3 is a process flow diagram of preferred embodiments of the system of the present invention.

Referring now to FIG. 3, a preferred embodiment of the system for delivering a supply of supercritical fluid to an application comprises a supply cylinder 2 of the type well-known in the industrial gas industry. The cylinder may be any size, but is typically a 50-lbs supply cylinder comprised of steel and having an outside diameter of between 20 cm and about 25 cm, typically about 23 cm in diameter. The system preferably comprises a plurality of supply cylinders, or bank of cylinders, in at least one cylinder bank. Cylinder outlet 12 is typically provided with a valve and a single outside threaded connection for delivery of gas from the cylinder.

In accordance with the present invention, the supply cylinder is provided with heating element 10 to conduct thermal energy to the fluid in supply cylinder 2. The preferred embodiment senses at least one property of the fluid in the cylinder through temperature-sensing means 18 or pressure-sensing means 16, each of which communicates a signal to control means 20 to control the thermal input to the fluid through heating means 10. The heating element may be a heating blanket or a band heater which may be obtained, for example, from Mc Masteo-Carr.

It is preferable to maintain the pressure of the fluid in the supply cylinder at between about 1100 and about 1400 psig, preferably at a set point of about 1250 psig. Thus, supercritical conditions are maintained in downstream flow apparatus. In the preferred embodiment, at least two banks of cylinders are connected via a manifold and a cylinder-switching valve 30 which directs flow from any of the cylinder banks to switching-valve outlet and line 32. Switching-valve 30 may be, for example, a three-way valve to control flow from two banks of cylinders and is available, for example, from Parker-Hannifin Corp. A pump 40 is provided to increase the pressure in discharge line 32 from a typical inlet pressure of about 950 psig (@70° F.) to between about 1100 and 3000 psig. It is noteable that one advantage, among many with the system of the present invention is that a much smaller displacement of a liquid pump is required than of a vapor compressor used in prior systems for delivering carbon dioxide to an application.

In accordance with the system of the present invention, single-phase flow is maintained in flow line 32 and, thus, pump 40 is not subject to detrimental pump cavitation. In the preferred embodiment, the system is further provided with high-pressure surge vessel 50 having a pressure-sensing switch 48 in fluid communication therewith. In accordance with the present invention, if the pressure in surge vessel 50 falls below a predetermined set point, a signal is transmitted to switching-valve 30 to switch to an alternative, higher-pressure supply source. Following such switching operation, a signal may also be communicated to the system operator to indicate one of the supply cylinders may be depleted and, therefore, should be replaced.

In an alternative embodiment, flow line 32 may be further provided with a heat exchanger providing heat input to allow even greater recovery from the cylinder banks. In accordance with the alternative embodiment, when heating element 10 is no longer able to provide sufficient heat input due to, for example, a high system withdrawal rate or ambient temperature conditions, two-phase flow may exist in manifold 28. Heat exchanger 36 is available under such conditions to assure a higher density, higher pressure fluid flow to pump 40, either alone or in combination with heating element 10 to further increase recovery from the cylinders.

It will be apparent to those skilled in the art having the benefit of the present disclosure that the manifold and flow lines may further comprise various pressure regulators, flow indicators, relief valves, and flow regulators as, for example, a discharge pressure regulator 52 at the discharge of surge vessel 50.

The system of the present invention may be provided in a fixed location, such as a manufacturing plant or the like or, alternatively, may be assembled as a mobile unit provided with various connections for hoses, utilities, and the like.

The present invention further includes a method of delivering a supercritical fluid to an application from a supply cylinder comprising the steps of providing a plurality of supply cylinders comprising fluid at or near supercritical conditions for said fluid; sensing at least one fluid property and adjusting the pressure of said fluid in said supply cylinders with heating means in response to said sensed fluid property; and pumping fluid with a pump from at least one of said supply cylinders to an application using said fluid.

The method may also preferably include the provision of a switching valve to selectively transfer flow from on of the supply cylinders or cylinder banks. The indication to switch supply is preferably received from sensing the pressure on a surge vessel downstream of the delivery pump. During the practice of the method, it is preferable to maintain the pressure of the fluid in the supply cylinders from which flow is derived at between about 1100 and about 1400 psig, most preferably about 1250 psig.

The above-described system and process are particularly useful in supplying a liquid carbon dioxide as a solvent to dilute coatings useful in application to a substrate. Supercritical carbon dioxide has a solvency which is similar to that of lower hydrocarbons such as butane, or hexane, or the like and may therefore be used as a substitute for such hydrocarbon-based solvents in application of coatings.

In using the supercritical solvent delivered from the above-described system, a mixture of organic coating compounds and such solvent is typically formed. Polymeric coating compounds suitable for use in this alternative embodiment of the present invention may comprise any of the polymers known to those skilled in the coatings art. Such materials may include thermoplastic or thermosetting materials, or crosslinkable film forming systems. The polymeric components useful may further comprise vinyl, acrylic, styrenic, and interpolymers of the base vinyl, acrylic, and styrenic monomers; polyesters, oil-free alkyds, alkyds, and the like; polyurethanes, "two package" polyurethanes, oil-modified polyurethanes, moisture-curing polyurethanes and thermoplastic urethanes systems; epoxy systems; phenolic systems; cellulosic esters such as acetate butyrate, acetate propionate, and nitrocellulose; amino resins such as urea formaldehyde, melamine formaldehyde, and other aminoplast polymers and resins materials; natural gums and resins; and enamels, varnishes, and lacquers, or mixtures thereof known to those skilled in the art to be formulated to achieve performance and cost balances required of commercially viable coating materials.

The polymer component of the coating composition is generally present in the liquid mixture in amounts ranging from about 5 to about 65, preferably between about 15 and about 55 weight percent, based upon the total weight of the polymer(s), other solvent(s), and supercritical fluid diluent.

The supercritical fluid diluent should be present in such amounts that a liquid mixture is formed that possesses such a viscosity that it may be applied as a liquid spray. Generally, this requires the mixture to have a viscosity of less than about 300 centipoise at spray temperature—preferably, from about 5 centipoise to about 150 centipoise, and most preferably from about 10 centipoise to about 50 centipoise.

If supercritical carbon dioxide fluid is employed as the supercritical fluid diluent, it preferably should be present in amounts ranging from about 10 to about 60 weight percent based upon the total weight of all components thereby producing a mixture having viscosities from about 5 centipoise to about 150 centipoise at spray temperature. Most preferably, the supercritical carbon dioxide fluid is present in amounts ranging from about 20 to about 60 weight percent on the same basis, thereby producing a mixture having viscosities from about 10 centipoise to about 50 centipoise at spray temperature.

Accordingly, the present invention includes a method of applying a coating to a substrate comprising: providing a plurality of supply cylinders comprising fluid at or near supercritical conditions for said fluid; sensing at least one fluid property and adjusting the temperature of said fluid in said supply cylinders with heating means in response to said sensed fluid property; pumping fluid with a pump from at least one of said supply cylinders to form a liquid mixture, said liquid mixture comprising a solvent component mixed with a portion of said fluid; and spraying at least a portion of said liquid mixture onto said substrate surface.

Although the present invention has been described in terms of preferred embodiments and system components, other variations will be readily apparent to those skilled in the art after review of the disclosure provided herein, the present invention is intended to only be limited in scope as defined by the following claims.

What is claimed is:

1. A system for delivery of fluid from cylinders comprising:

a) a plurality of supply cylinders containing fluid, each cylinder comprising a fluid outlet;

b) sensing means for sensing at least one fluid property in at least one cylinder of said plurality of supply cylinders;

c) heating means adapted to said plurality of supply cylinders and coupled to said sensing means to adjust the pressure of said fluid in said supply cylinders in response to said at least one sensed fluid property to maintain said fluid under supercritical conditions;

d) pump means to deliver fluid from said cylinder outlet to an application.

2. The system as recited in claim 1 wherein said fluid is carbon dioxide.

3. The system as recited in claim 2 wherein said fluid in said plurality of supply cylinder is at or near supercritical conditions.

4. The system as recited in claim 1 further comprising a switching valve to direct the flow from said plurality of supply cylinders to said pump means.

5. The system as recited in claim 4 wherein said switching valve is located between a plurality of cylinder banks, each bank comprising a plurality of supply cylinders.

6. The system as recited in claim 5 further comprising a surge vessel receiving high-pressure fluid from said pump means.

7. The system as recited in claim 6 further comprising control means for sensing pressure on said surge vessel and selecting flow from said plurality of cylinders.

8. The system as recited in claim 1 wherein said heating element is a heating blanket or heating band.

9. The system as recited in claim 1 wherein said sensing means comprises fluid temperature sensor and a fluid pressure sensor to monitor the temperature of the fluid in said cylinder and pressure at said fluid outlet.

10. The system as recited in claim 4 further comprising a heat exchanger upstream of said pump and downstream of said switching valve.

11. The system as recited in claim 1 further comprising an alarm indicating at least one of said supply cylinders is depleted based upon said sensed-fluid property.

12. The system as recited in claim 1 wherein said supply cylinders are non-siphoned.

* * * * *